US005806501A

United States Patent [19]

Osanai

[11] Patent Number: 5,806,501

[45] Date of Patent: Sep. 15, 1998

[54] EVAPORATED FUEL TREATMENT DEVICE OF AN ENGINE

[75] Inventor: Akinori Osanai, Susono, Japan

[73] Assignee: Toyota Jidosha Kabushiki Kaisha, Aichi, Japan

[21] Appl. No.: 895,180

[22] Filed: Jul. 16, 1997

[30] Foreign Application Priority Data

Jul. 17, 1996 [JP] Japan ..... 8-187710

[51] Int. Cl.[6] ..... F02M 37/04; F02M 25/08

[52] U.S. Cl. ..... 123/520; 123/698

[58] Field of Search ..... 123/698, 674, 123/520, 521, 519, 518, 516, 357

[56] References Cited

U.S. PATENT DOCUMENTS

| | | | |
|---|---|---|---|
| 5,216,997 | 6/1993 | Osanai | 123/520 |
| 5,299,546 | 4/1994 | Kato | 123/520 |
| 5,406,927 | 4/1995 | Rato | 123/698 |
| 5,445,132 | 8/1995 | Isobe | 123/520 |
| 5,499,617 | 3/1996 | Ritasima | 123/698 |
| 5,596,972 | 1/1997 | Sultan | 123/520 |
| 5,606,955 | 3/1997 | Yuda | 123/520 |
| 5,609,142 | 3/1997 | Osanai | 123/520 |
| 5,634,452 | 6/1997 | Hara | 123/520 |
| 5,694,911 | 12/1997 | Kawamoto | 123/698 |

FOREIGN PATENT DOCUMENTS

| | | |
|---|---|---|
| 61-19962A | 1/1986 | Japan . |
| 62591A | 1/1994 | Japan . |
| 777111A | 3/1995 | Japan . |
| 7247919A | 9/1995 | Japan . |

*Primary Examiner*—Carl S. Miller
*Attorney, Agent, or Firm*—Kenyon & Kenyon

[57] ABSTRACT

An evaporated fuel treatment device comprising a purge control valve arranged between a canister and an intake passage of an engine. A drive pulse of the purge control valve is controlled by a duty ratio. When the purge action starts, the duty ratio is gradually increased. In the region of a small duty ratio where the flow rate of the purge control valve becomes unstable, the duty ratio is either increased or else held constant so that the duty ratio is not allowed to fall.

13 Claims, 16 Drawing Sheets

EVAPORATED FUEL TREATMENT DEVICE OF AN ENGINE

BACKGROUND OF THE INVENTION

1. Field of the Invention

The present invention relates to an evaporated fuel treatment device of an engine.

2. Description of the Related Art

When a large amount of fuel vapor is rapidly purged in an engine intake passage, feedback control of the air-fuel ratio becomes difficult and the air-fuel ratio fluctuates widely. Therefore, known in the art is an internal combustion engine where the air-fuel ratio is prevented from fluctuating widely by gradually increasing the amount of purge of the fuel vapor, that is, gradually increasing the amount of opening of the purge control valve for controlling the amount of purge, when starting the purge action of the fuel vapor (see Japanese Unexamined Patent Publication (Kokai) No. 7-247919).

Even when gradually increasing the amount of opening of the purge control valve in this way, however, if trying to reduce the amount of opening of the purge control valve when the air-fuel ratio fluctuates during the action of increasing the amount of opening, for example, when the air-fuel ratio becomes rich, a problem occurs of the air-fuel ratio fluctuating between the rich and lean states. This will be explained next referring to FIG. 16A and FIG. 16B.

FIG. 16A shows schematically the purge control valve which is generally used. A shows a valve body, B a spring, C a core, and D a solenoid. A drive pulse is applied to the solenoid. By controlling the duty ratio of the drive pulse, the amount of opening of the valve body A is controlled. FIG. 16B shows the relationship between the duty ratio of the drive pulse applied to the solenoid D and the flow rate of the purge. As will be understood from FIG. 16B, when the duty ratio becomes large to a certain extent, the flow rate of the purge is proportional to the duty ratio as shown by the solid line, but when the duty ratio becomes small, the flow rate of the purge no long is proportional to the duty ratio as shown by the broken line.

That is, as shown in FIG. 16A, in a purge control valve, for the valve body A to open, an electromagnetic force of attraction enough to overcome the spring force of the spring B and the force of attraction of the negative pressure acting on the top center of the valve body A is necessary, therefore the valve body A will not open unless the duty ratio becomes large enough to a certain extent. Further, when the valve body A opens, the amount of opening of the valve body A becomes large all at once. Further, when the duty ratio is small, since the time of generation of the drive pulse is short, the valve body A will not open completely. Since the position of the valve body A at this time is not set, the flow rate of purge will become unstable. The region where the flow rate of purge becomes unstable in this way is the region surrounded by the broken line S. For example, the region of the unstable flow rate becomes that where the duty ratio is less than 8 percent.

In this region of unstable flow rate, if the duty ratio exceeds a certain value, the valve body A will open all at once and therefore a large amount of fuel vapor will rapidly be purged into the intake passage, so the air-fuel ratio will become rich temporarily. If the air-fuel ratio becomes rich temporarily, the duty ratio will be reduced to reduce the flow rate of purge. If the duty ratio falls to below a certain value, the valve body A will then end up rapidly closing. As a result, the purge action of the fuel vapor will rapidly be stopped and then the air-fuel ratio will become lean. If the air-fuel ratio becomes lean, the duty ratio will be increased again to increase the flow rate of purge. When the duty ratio exceeds a certain value, the valve body A will open all at once. In this way, the air-fuel ratio will fluctuate between the rich and lean states.

If the air-fuel ratio fluctuates in this way, not only will the engine speed fluctuate, but also in some cases a problem will arise leading even to engine stalling.

SUMMARY OF THE INVENTION

An object of the present invention is to provide an evaporated fuel treatment device capable of preventing an air-fuel ratio from fluctuating when the purge operation of the evaporated fuel is carried out.

According to a first aspect of the invention, there is provided an evaporated fuel treatment device for an engine provided with an intake passage, comprising; a purge control valve for controlling an amount of purge of fuel vapor to be purged to the intake passage; air-fuel ratio detecting means for detecting the air-fuel ratio; valve opening controlling means for increasing or reducing the amount of opening of the purge control valve in accordance with fluctuations in the air-fuel ratio when the purge action of the fuel vapor has been started so as to make the purge control valve gradually open from the fully closed state to the target opening degree; judging means for judging if the amount of opening of the purge control valve is in a predetermined region of unstable flow; and prohibiting means for prohibiting the amount of opening of the purge control valve from being reduced when the amount of opening of the purge control valve is in the region of unstable flow.

According to a second aspect of the invention, there is provided an evaporated fuel treatment device for an engine provided with an intake passage, comprising; a purge control valve for controlling an amount of purge of fuel vapor to be purged to the intake passage; and valve opening controlling means for instantaneously opening the purge control valve from the fully closed state to the minimum amount of opening of stable flow and holding it temporarily at the minimum amount of opening when the purge action of the fuel vapor has started and then gradually opening the purge control valve toward the target degree of opening.

BRIEF DESCRIPTION OF THE DRAWINGS

These and other objects and features of the present invention will become more apparent from the following description of the preferred embodiments given with reference to the attached drawings, in which.

DESCRIPTION OF THE PREFERRED EMBODIMENTS

Figure 1:
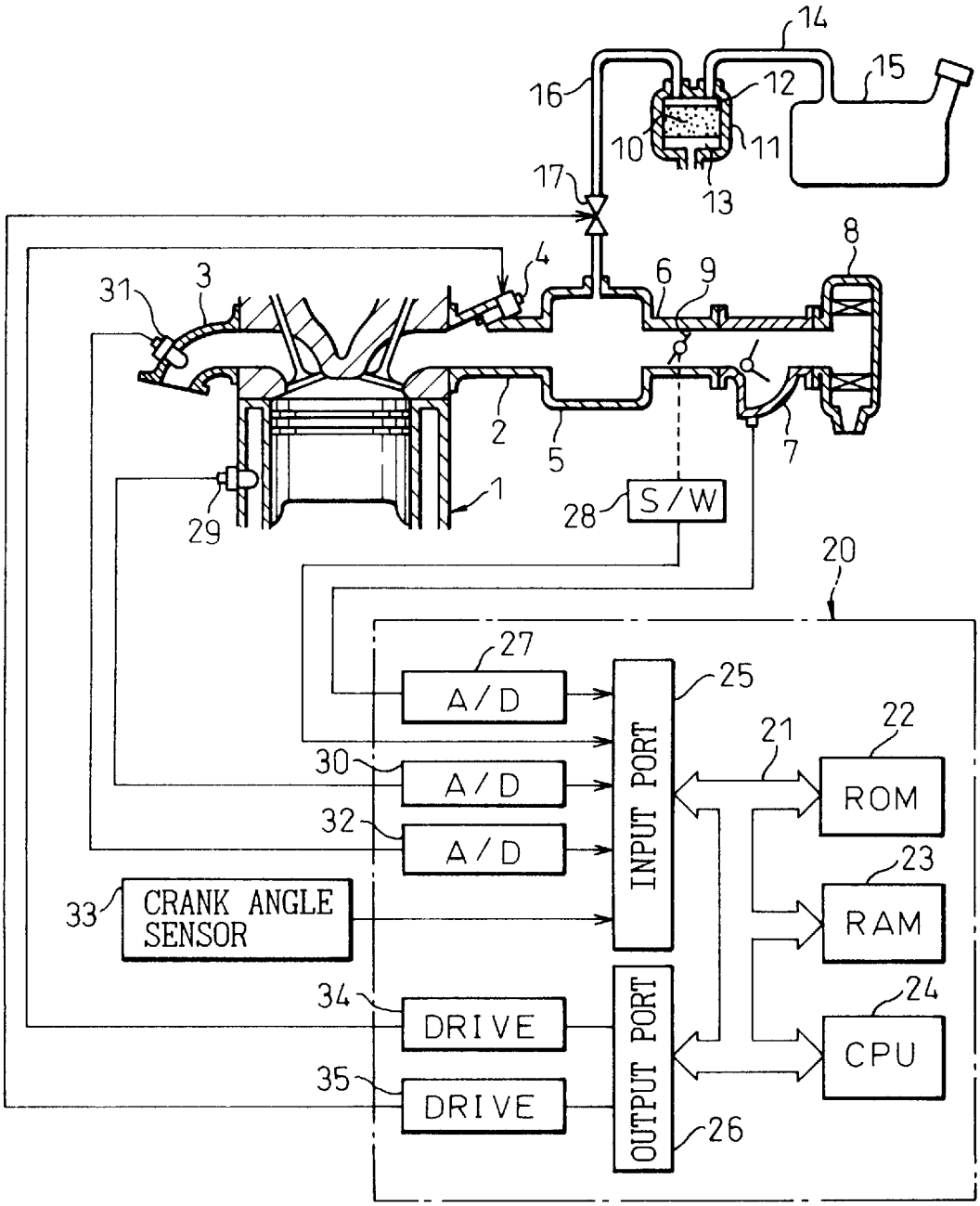
FIG. 1 is an overall view of an internal combustion engine.

Referring to FIG. 1, 1 is an engine body, 2 an intake tube, 3 an exhaust manifold, and 4 a fuel injector attached to each of the intake tubes 2. Each intake tube 2 is connected to a common surge tank 5. The surge tank 5 is connected through an intake duct 6 and an air flow meter 7 to an air cleaner 8. In the intake duct 6 is arranged a throttle valve 9. Further, as shown in FIG. 1, the internal combustion engine has disposed in it a canister 11 containing activated carbon 10. The canister 11 has a fuel vapor chamber 12 and an atmospheric chamber 13 on the two sides of the activated carbon 10. The fuel vapor chamber 12 on the one hand is connected through a conduit 14 to a fuel tank 15 and on the other hand through a conduit 16 to the inside of the surge tank 5. In the conduit 16 is disposed a purge control valve 17 which is controlled by output signals from an electronic control unit 20. The fuel vapor which is generated in the fuel tank 15 is sent through the conduit 14 into the canister 11 where it is absorbed by the activated carbon 10. When the purge control valve 17 opens, the air is sent from the atmospheric chamber 13 through the activated carbon 10 into the conduit 16. When the air passes through the activated carbon 10, the fuel vapor which is absorbed in the activated carbon 10 is released from the activated carbon 10 therefore air containing the fuel vapor is purged through the conduit 16 to the inside of the surge tank 5.

The electronic control unit 20 is comprised of a digital computer and is provided with a read only memory (ROM) 22, a random access memory (RAM) 23, a microprocessor (CPU) 24, an input port 25, and an output port 26 connected to each other through a bidirectional bus 21. The air flow meter 7 generates an output voltage proportional to the amount of the intake air. This output voltage is input through the AD converter 27 to the input port 25. The throttle valve 9 has attached to it a throttle switch 28 which becomes on when the throttle valve 9 is at the idle open position. The output signal of the throttle switch 28 is input to the input port 25. The engine body 1 has attached to it a water temperature sensor 29 for generating an output voltage proportional to the coolant water temperature of the engine. The output voltage of the water temperature sensor 29 is input through the AD converter 30 to the input port 25. The exhaust manifold 3 has an air-fuel ratio sensor 31 attached to it. The output signal of the air-fuel ratio sensor 31 is input through the AD converter 32 to the input port 25. Further, the input port 25 has connected to it a crank angle sensor 33 generating an output pulse every time the crankshaft rotates by for example 30 degrees. In the CPU 24, the engine speed is calculated based on this output pulse. On the other hand, the output port 26 is connected through the corresponding drive circuits 34 and 35 to the fuel injectors 4 and the purge control valve 17.

In the internal combustion engine shown in FIG. 1, the fuel injection time TAU is calculated based fundamentally on the following equation:

$$TAU=TP\cdot\{K+FAF-FPG\}$$

where, the coefficients show the following:

TP: basic fuel injection time

K: correction coefficient

FAF: feedback correction coefficient

FPG: purge A/F correction coefficient

The basic fuel injection time TP is the experimentally found injection time required for making the air-fuel ratio the target air-fuel ratio. The basic fuel injection time TP is stored in advance in the ROM as a function of the engine load Q/N (amount of intake air Q/engine speed N) and the engine speed N.

The correction coefficient K expresses the engine warmup increase coefficient and the acceleration increase coefficient all together. When there is no upward correction is needed, K is made 0.

The purge A/F correction coefficient FPG is for correction of the amount of injection when the purge has been performed. The period from when the engine operation is started to when the purge is started is FPG=0.

The feedback correction coefficient FAF is for controlling the air-fuel ratio to the target air-fuel ratio based on the output signal of the air-fuel ratio sensor 31. As the target air-fuel ratio, any air-fuel ratio may be used, but in the embodiment shown in FIG. 1, the target air-fuel ratio is made the stoichiometric air-fuel ratio, therefore the explanation will be made of the case of making the target air-fuel ratio the stoichiometric air-fuel ratio hereafter. Note that when the target air-fuel ratio is the stoichiometric air-fuel ratio, as the air-fuel ratio sensor 31, a sensor whose output voltage changes in accordance with the concentration of oxygen in the exhaust gas is used, therefore hereinafter the air-fuel ratio sensor 31 will be referred to as an $O_2$ sensor. This $O_2$ sensor 31 generates an output voltage of about 0.9V when the air-fuel ratio is rich and generates an output voltage of about 0.1V when the air-fuel ratio is lean. First, an explanation will be made of the control of the feedback correction coefficient FAF performed based on the output signal of this $O_2$ sensor 31.

Figure 2:
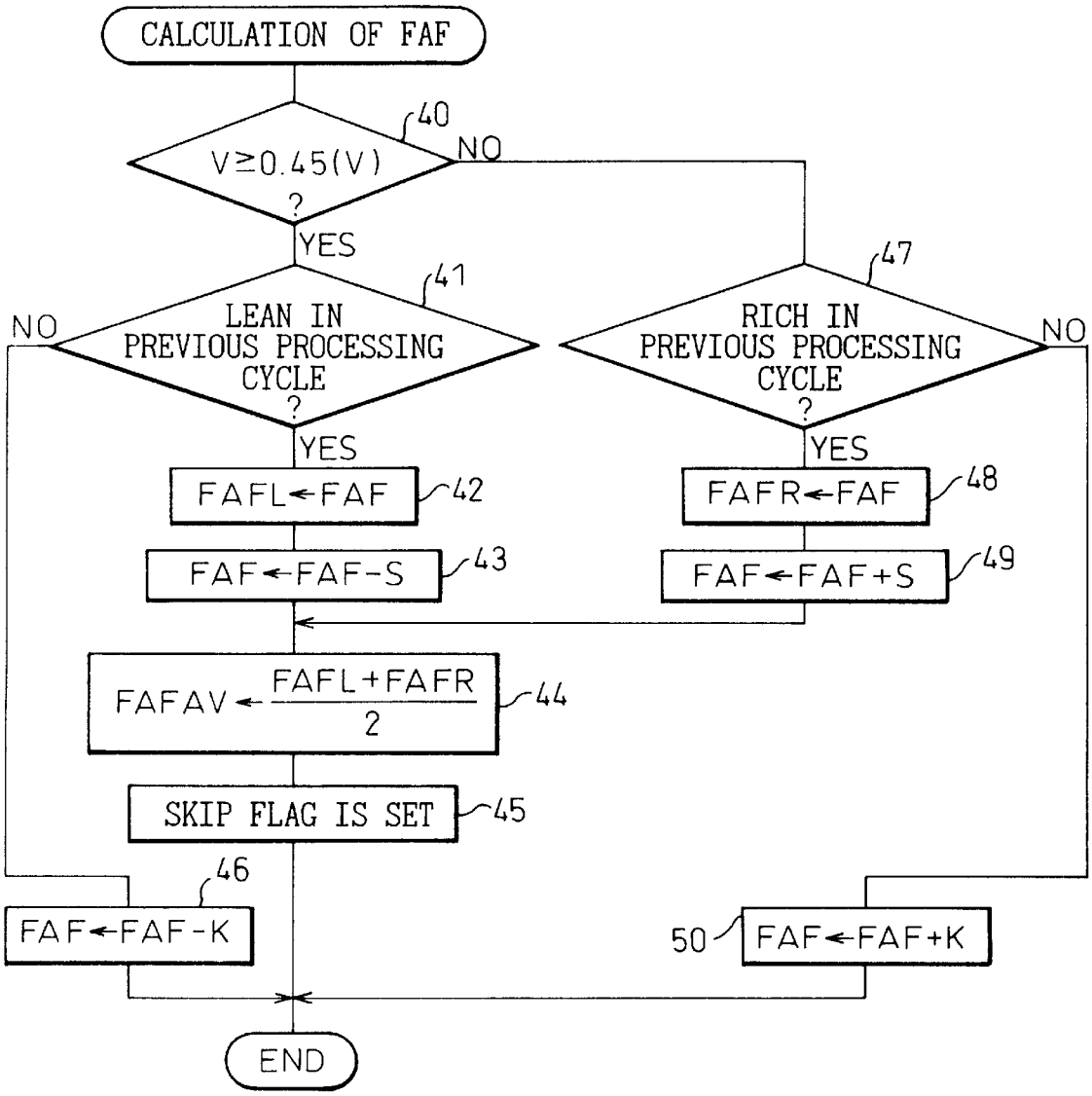
FIG. 2 is a flow chart for calculating an air-fuel ratio feedback correction coefficient FAF.

FIG. 2 shows the routine for calculation of the feedback correction coefficient FAF. This routine is executed for example within a main routine.

Figure 3:
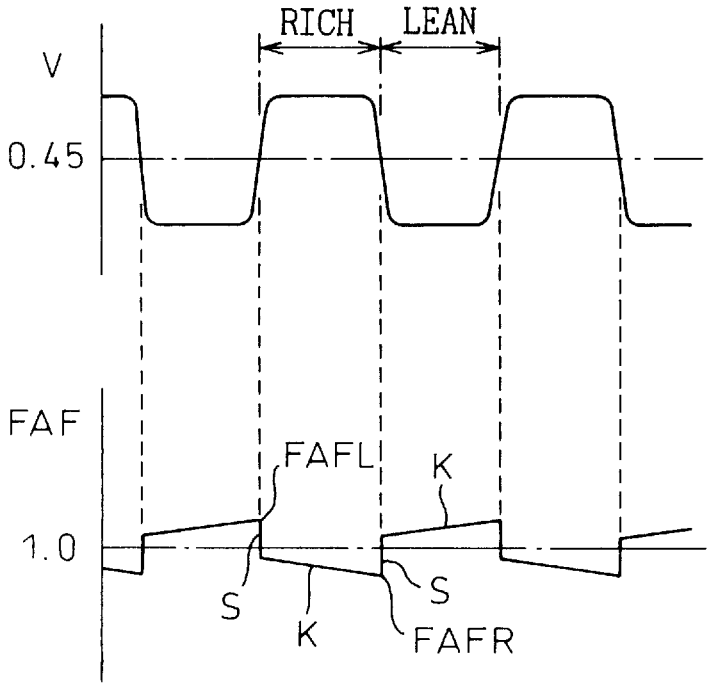
FIG. 3 is a view of the changes in the air-fuel ratio feedback correction coefficient FAF.

Referring to FIG. 2, first, at step 40, it is judged whether the output voltage of the $O_2$ sensor 31 is higher than 0.45V or not, that is, whether the air-fuel ratio is rich or not. When V>0.45V, that is, when the air-fuel ratio is rich, the routine proceeds to step 41, where it is judged if the air-fuel ratio was lean at the time of the previous processing cycle or not. When it was lean at the time of the previous processing cycle, that is, when it has changed from lean to rich, the routine proceeds to step 42, where the feedback control coefficient FAF is made FAFL and the routine proceeds to step 43. At step 43, a skip valve S is subtracted from the feedback control coefficient FAF, therefore, as shown in FIG. 3, the feedback control coefficient FAF is rapidly reduced by the skip valve S. Next, at step 44, the average value FAFAV of the FAFL and FAFR is calculated. Next, at step 45, the skip flag is set. On the other hand, when it is judged at step 41 that the air-fuel ratio was rich at the time of the previous processing cycle, the routine proceeds to step 46, where the integral value K (K<<S) is subtracted from the feedback control coefficient FAF. Therefore, as shown in FIG. 2, the feedback control coefficient FAF is gradually reduced.

On the other hand, when it is judged at step 40 that V<0.45V, that is, when the air-fuel ratio is lean, the routine proceeds to step 47, where it is judged if the air-fuel ratio was rich at the time of the previous processing cycle. When it was rich at the time of the previous processing cycle, that is, when it changed from rich to lean, the routine proceeds to step 48, where the feedback control coefficient FAF is made FAFR and the routine proceeds to step 49. At step 49, the skip value S is added to the feedback control coefficient FAF, therefore, as shown in FIG. 3, the feedback control coefficient FAF is rapidly increased by exactly the skip value S. Next, when it was judged at step 44 that the air-fuel ratio was lean at the time of the previous processing cycle, the routine proceeds to step 50, where the integral value K is added to the feedback control coefficient FAF. Therefore, as shown in FIG. 3, the feedback control coefficient FAF is gradually increased.

When the air-fuel ratio becomes rich and FAF becomes smaller, the fuel injection time TAU becomes shorter, while when the air-fuel ratio becomes lean and the FAF increases, the fuel injection time TAU becomes longer, so the air-fuel ratio is maintained at the stoichiometric air-fuel ratio. Note that when the purge action is not performed, as shown in FIG. 3, the feedback control coefficient FAF fluctuates about 1.0. Further, as will be understood from FIG. 3, the average value FAFAV calculated at step 44 shows the average value of the feedback control coefficient FAF.

As will be understood from FIG. 3, the feedback control coefficient FAF is made to change relatively slowly by the integral constant K, so if a large amount of fuel vapor is rapidly purged into the surge tank 5 and the air-fuel ratio rapidly fluctuates, it no longer becomes possible to maintain the air-fuel ratio at the stoichiometric air-fuel ratio and therefore the air-fuel ratio fluctuates. Therefore, in the embodiment shown in FIG. 1, to prevent the air-fuel ratio from fluctuating, when the purge is performed, the amount of the purge is gradually increased. That is, in the embodiment shown in FIG. 1, by controlling the duty ratio of the drive pulse applied to the purge control valve 17, the amount of opening of the purge control valve 17 is controlled. When the purge is started, the duty ratio of the drive pulse is gradually increased. If the duty ratio of the drive pulse is gradually increased in this way, that is, if the amount of purge is gradually increased, even during the increase in the amount of the purge, the air-fuel ratio will be maintained at the stoichiometric air-fuel ratio by the feedback control by the feedback control coefficient FAF, therefore it is possible to prevent the air-fuel ratio from fluctuating.

Figure 16A:
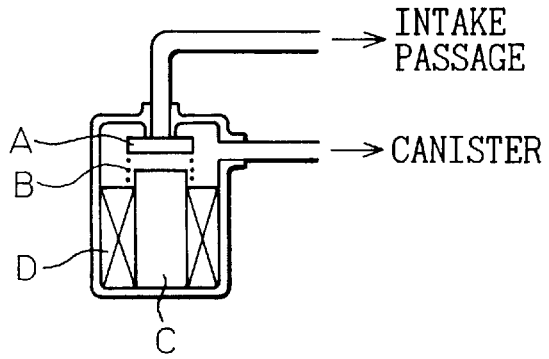
FIGS. 16A and 16B are views of the relationship between the duty ratio of a drive pulse of a purge control valve and the flow rate of purge.
Figure 16B:
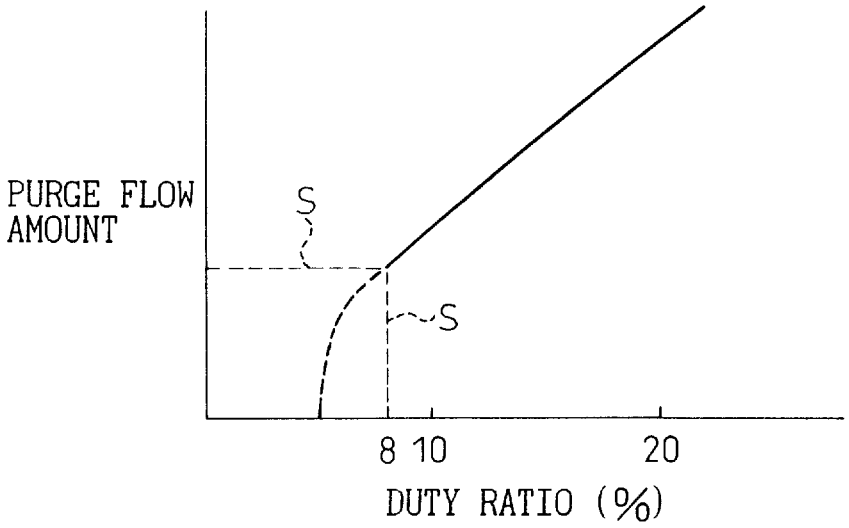

As mentioned at the start, however, if the amount of opening of the purge control valve 17 is gradually increased when the purge is started, that is, in this embodiment according to the embodiment, if the duty ratio of the drive pulse is gradually increased, there is the problem that the air-fuel ratio will fluctuate between rich and lean. Therefore, in the first embodiment of the present invention, when the purge is started, if the duty ratio of the drive pulse is in the region of unstable flow shown in FIG. 16B, the duty ratio of the drive pulse is prohibited from falling. This will be explained next referring to FIG. 4.

Figure 4:
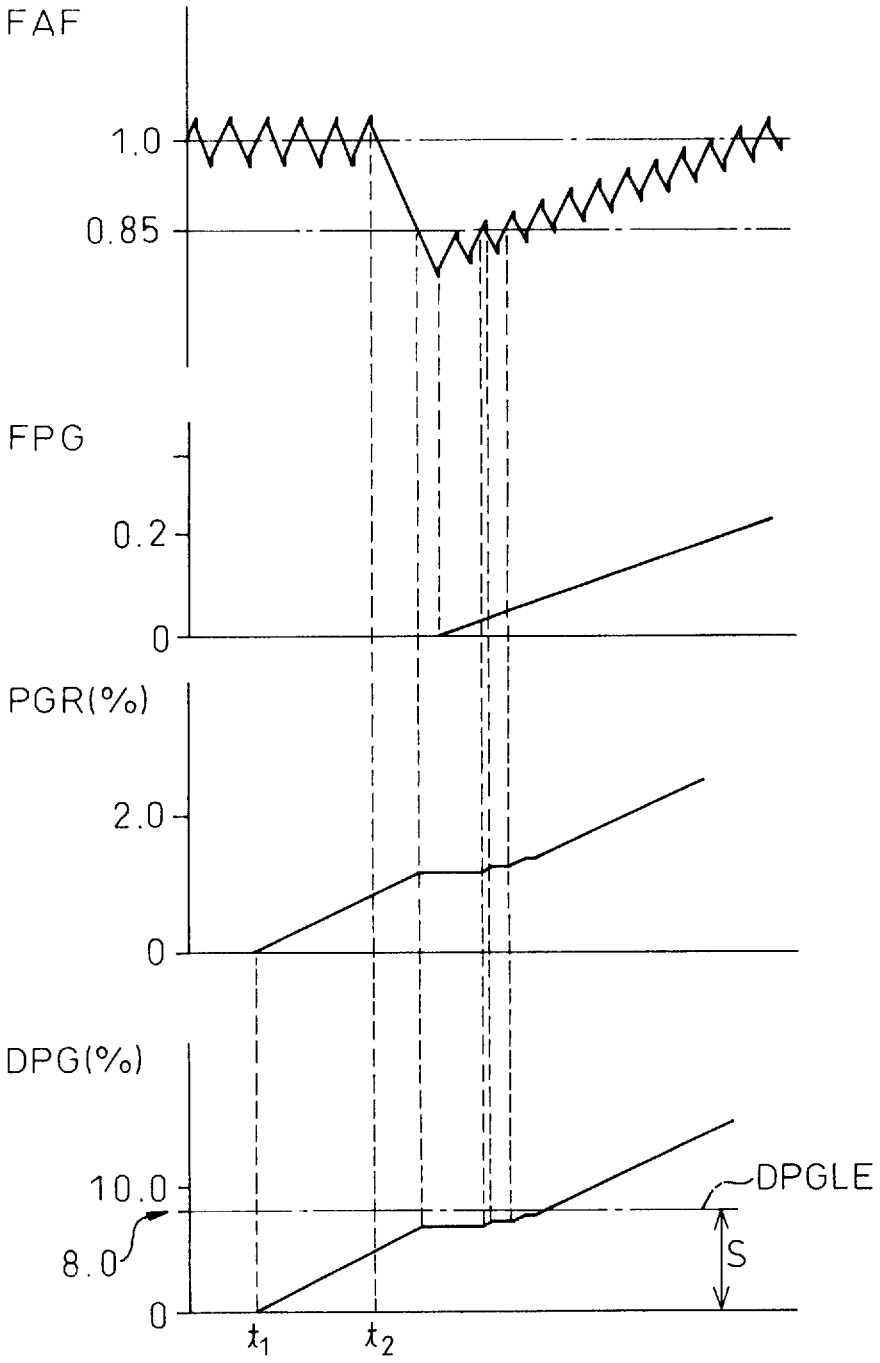
FIG. 4 is a time chart of the purge control.

FIG. 4 shows the changes in the feedback control coefficient FAF, the changes in the purge A/F correction coefficient FPG, the changes in the purge rate PGR, and the changes in the duty ratio DPG of the drive pulse. In FIG. 4, $t_1$ shows the time of the start of the purge, therefore, from FIG. 4, when the purge is started, the duty ratio DPG of the drive pulse is gradually increased, so the purge ratio PGR is gradually increased, it is seen. Even if the duty ratio DPG is gradually increased in this way, the purge control valve 17 remains closed.

On the other hand, the time $t_2$ of FIG. 4 shows when the purge control valve 17 rapidly opens. If the purge control valve 17 rapidly opens, a large amount of fuel vapor is rapidly supplied into the surge tank 5, so the air-fuel ratio becomes rich and therefore the feedback control coefficient FAF for making the air-fuel ratio the stoichiometric air-fuel ratio continues to fall. Next, FAF becomes smaller than even 0.85. FAF becoming smaller than even 0.85 means that a large amount of fuel vapor is being purged, therefore normally when FAF becomes smaller than even 0.85, the duty ratio DPG is reduced and the purge rate PGR is reduced.

In the first embodiment, however, when FAF becomes smaller than even 0.85, the duty ratio DPG is maintained at the duty ratio DPG at that time. Next, if FAF becomes larger than 0.85, the duty ratio DPG is again increased. If FAF once again becomes smaller than even 0.85 later, the duty ratio DPG is maintained at the duty ratio DPG at that time. Next, when the duty ratio DPG leaves the region S of unstable flow, that is, when it becomes larger than the minimum duty ratio DPGLE of stabilization of the flow rate, the duty ratio DPG is gradually increased. In this way, in the first embodiment, when the duty ratio DPG is in the region S of unstable flow, when the duty ratio DPG should be reduced due to the fluctuation of the air-fuel ratio, the duty ratio DPG is held constant, so the purge control valve 17 will not close rapidly and therefore the air-fuel ratio can be prevented from fluctuating between rich and lean.

Note that as shown in FIG. 4, when the FAF becomes smaller than 0.85 and then rises, that is, when the FAF becomes smaller than 0.85 and then the air-fuel ratio starts to be maintained at the stoichiometric air-fuel ratio, the purge A/F correction coefficient FPG is gradually increased and, along with this, FAF is gradually returned to 1.0. Next, when FAF starts to fluctuate about 1.0, the purge A/F correction coefficient FPG is maintained substantially constant. The value of the purge A/F correction coefficient FPG at this time shows the amount of fluctuation of the air-fuel ratio due to the purge of the fuel vapor. When after this, the purge action is stopped and then the purge action is restarted, the value of the FPG at the time of the stopping of the purge is used as the value of the purge A/F correction coefficient FPG and the value of the DPG at the time of the stopping of the purge is used as the value of the duty ratio DPG of the drive pulse.

Next, an explanation will be made of the routine for control of the purge with reference to FIG. 5 to FIG. 7. Note that this routine is executed by interruption every predetermined time.

Figure 5:
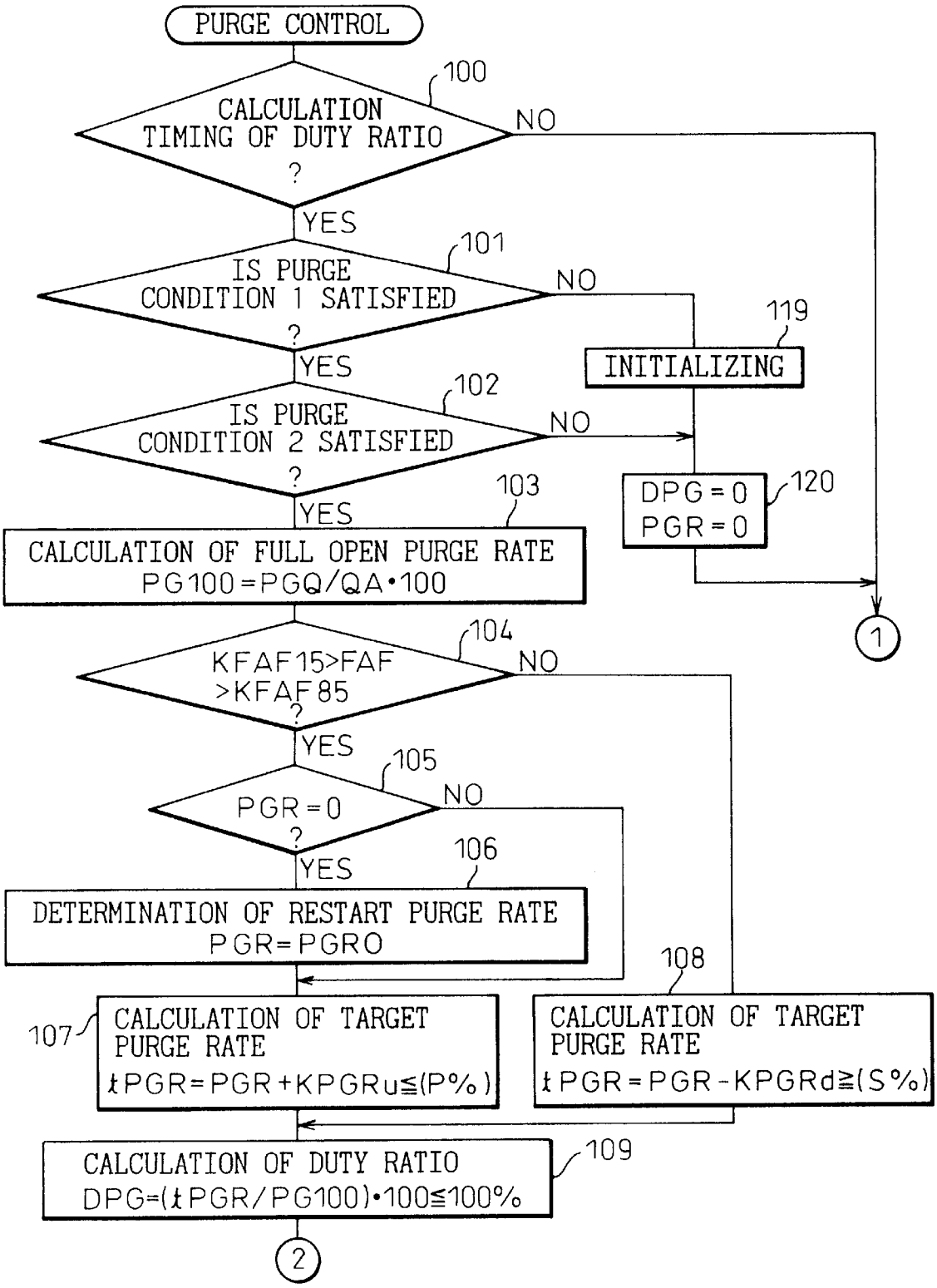
FIGS. 5 and 6 are flow charts for executing the purge control.
Figure 6:
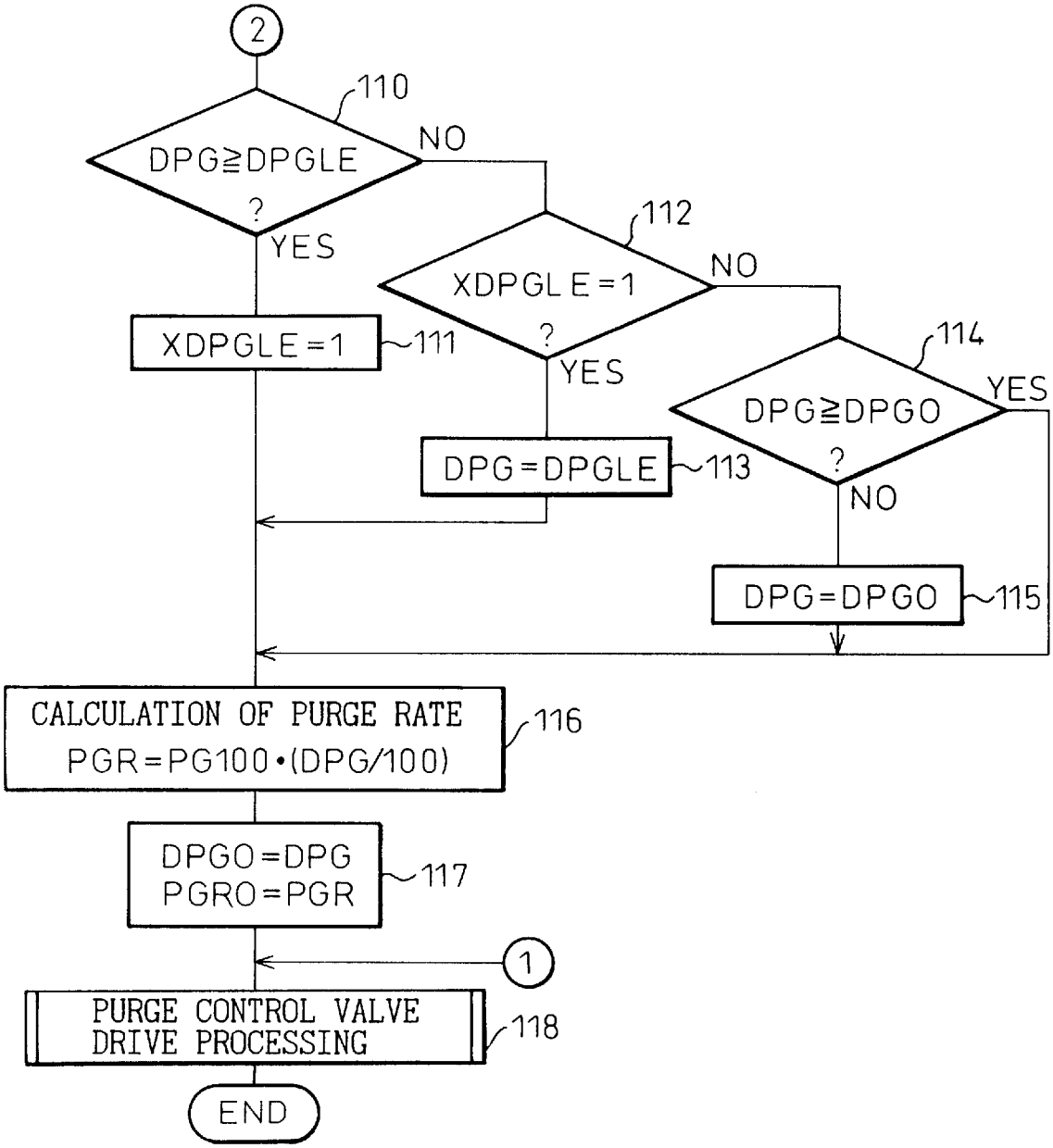

Referring to FIG. 5 and FIG. 6, first, at step 100, it is judged whether the time is the time of calculation of the duty ratio of the drive pulse of the purge control valve 17 or not. In the embodiment according to the present invention, the duty ratio is calculated every 100 msec. When not the time for calculation of the duty ratio, the routine jumps to step 118, where the processing for driving the purge control valve 17 is executed. As opposed to this, when it is the time for calculation of the duty ratio, the routine proceeds to step 101, where it is judged if the purge condition 1 is satisfied or not, for example, if the engine warmup has been completed or not. When the purge condition 1 is not satisfied, the routine proceeds to step 119, where the initialization processing is performed, then at step 120, the duty ratio DPG and the purge rate PGR are made zero. As opposed to this, when the purge condition 1 is satisfied, the routine proceeds to step 102, where it is judged if the purge condition 2 is satisfied or not, for example, whether feedback control of the air-fuel ratio is being performed or not. When the purge condition 2 is not satisfied, the routine proceeds to step 120, while when the purge condition 2 is satisfied, the routine proceeds to step 103.

At step 103, the ratio between the full open purge amount PGQ and the amount QA of intake air, that is, the full open purge rate PG100 (=(PGQ/QA)·100) is calculated. Here, the full open purge amount PGQ shows the amount of purge when the purge control valve 17 is fully open. The full open purge rate PG100 is a function of for example the engine load Q/N (amount QA of intake air/engine speed N) and the engine speed N and is found in advance by experiments. It is stored in advance in the ROM 22 in the form of a map as shown in the following table.

TABLE 1

| | Q/N | | | | | | | | | | |
|---|---|---|---|---|---|---|---|---|---|---|---|
| N | 0.15 | 0.30 | 0.45 | 0.60 | 0.75 | 0.90 | 1.05 | 1.20 | 1.35 | 1.50 | 1.65 |
| 400 | 25.6 | 25.6 | 21.6 | 15.0 | 11.4 | 8.6 | 6.3 | 4.3 | 2.8 | 0.8 | 0 |
| 800 | 25.6 | 16.3 | 10.8 | 7.5 | 5.7 | 4.3 | 3.1 | 2.1 | 1.4 | 0.4 | 0 |
| 1600 | 16.6 | 8.3 | 5.5 | 3.7 | 2.8 | 2.1 | 1.5 | 1.2 | 0.9 | 0.3 | 0 |
| 2400 | 10.6 | 5.3 | 3.5 | 2.4 | 1.8 | 1.4 | 1.1 | 0.8 | 0.6 | 0.3 | 0.1 |
| 3200 | 7.8 | 3.9 | 2.5 | 1.8 | 1.4 | 1.1 | 0.9 | 0.6 | 0.5 | 0.4 | 0.2 |
| 4000 | 6.4 | 3.2 | 2.1 | 1.5 | 1.2 | 0.9 | 0.7 | 0.6 | 0.4 | 0.4 | 0.3 |

The lower the engine load Q/N becomes, the larger the full open purge amount PGQ with respect to the amount QA of intake air becomes, so as shown in Table 1, the full open purge rate PG100 becomes larger the lower the engine load Q/N becomes and the full open purge amount PGQ with respect to the amount QA of intake air becomes larger the lower the engine speed N becomes, so as shown in Table 1, the full open purge rate PG100 becomes larger the lower the engine speed N.

Next, at step 104, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 105, where it is judged whether the purge rate PGR is zero or not. That is, when the purge action is being performed, PGR>0, so at this time the routine jumps to step 107. As opposed to this, when the purge action has not started, the routine proceeds to step 106, where the purge rate PGR0 is made the restart purge rate PGR. When the purge condition 1 and the purge condition 2 are satisfied for the first time since the start of operation of the engine, the purge rate PGR0 has been made zero by the initialization processing (step 119), so at this time PGR=0. As opposed to this, when the purge action has been suspended once and then the purge control is resumed, the purge rate PGR0 at the time when the purge control had been suspended is made the restart purge rate PGR.

Next, at step 107, the target purge rate tPGR (=PGR+KPRGu) is calculated by adding a constant value KPGRu to the purge rate PGR. That is, when KFAF15>FAF>KFAF85, it is understood, the target purge rate tPGR is gradually increased every 100 msec. Note that an upper limit value P (P is for example 6%) is set for this target purge rate tPGR, therefore the target purge rate tPGR can only rise up to this upper limit value P. Next, the routine proceeds to step 109.

On the other hand, when it is judged at step 104 that FAF≧KFAF15 or FAF≦KFAF85, the routine proceeds to step 108, where the constant value KPGRd is subtracted from the purge rate PGR to calculate the target purge rate tPGR (=PGR−KPGRd). That is, when the air-fuel ratio cannot be maintained at the stoichiometric air-fuel ratio due to the purge action of the fuel vapor, the target purge rate tPGR is reduced. Note that a lower limit value S (S=0%) is set for the target purge rate tPGR. Next, the routine proceeds to step 109.

At step 109, the target purge rate tPGR is divided by the full open purge rate PG100 to calculate the duty ratio DPG (=(tPGR/PG100)·100) of the drive pulse of the purge control valve 17. Therefore, the duty ratio DPG of the drive pulse of the purge control valve 17, that is, the amount of opening of the purge control valve 17, is controlled in accordance with the ratio of the target purge rate tTPG to the full open purge rate PG100. If the amount of opening of the purge control valve 17 is. controlled in accordance with the ratio of the target purge rate tTPG to the full open purge rate PG100 in this way, no matter what purge rate the target purge rate tTPG is, regardless of the engine operating state, the actual purge rate will be maintained at the target purge rate and therefore the air-fuel ratio will no longer fluctuate.

Suppose for example that the target purge rate tTPG is 2 percent and the full open purge rate PG100 at the current operating state is 10 percent. The duty ratio DPG of the drive pulse will become 20 percent and the actual purge rate at this time will become 2 percent. Next, supposing that the operating state changes and the full open purge rate PG100 at the changed operating state becomes 5 percent, the duty ratio DPG of the duty ratio will become 40 percent and the actual purge ratio at this time will become 2 percent. That is, if the target purge rate tTPG is 2 percent, the actual purge rate will become 2 percent regardless of the engine operating state. If the target purge rate tTPG changes and becomes 4 percent, the actual purge rate will be maintained at 4 percent regardless of the engine operating state.

Next, at step 110, it is judged if the duty ratio DPG is larger than the minimum duty ratio DPGLE of stable flow rate or not. In the embodiment according to the present invention, the minimum duty ratio DPGLE is made 8 percent. When it is judged at step 110 that DPG≧DPGLE, the routine proceeds to step 111, where the duty ratio lower limit flag XDPGLE showing that the duty ratio DPG after the start of the purge exceeded the minimum duty ratio DPGLE is set (XDPGLE=1). Next, the routine proceeds to step 116.

On the other hand, when DPG<DPGLE, the routine proceeds to step 112, where it is judged if the duty ratio lower limit flag XDPGLE has been set or not. When the duty ratio lower limit flag XDPGLE has been set, the routine proceeds to step 113, where the minimum duty ratio DPGLE is made the duty ratio DPG. That is, if the duty ratio DPG exceeds the minimum duty ratio DPGLE once after the purge action has started, even if the target purge rate tPGR becomes smaller and the duty ratio DPG becomes smaller than the minimum duty ratio DPGLE, the duty ratio DPG will be maintained at the minimum duty ratio DPGLE and therefore the duty ratio DPG will not intrude into the region S of unstable flow.

As opposed to this, when it is judged at step 112 that the duty ratio lower limit flag XDPGLE has not been set, that is, when the duty ratio DPG has not yet exceeded the minimum duty ratio DPGLE after the start of the purge action, the routine proceeds to step 114, where it is judged if the duty ratio DPG is larger than the duty ratio DPG0 calculated previously or not. When DPG≧DPG0, the routine proceeds to step 115, where the duty ratio DPG is made the previously calculated DPG0 and then the routine proceeds to step 116.

That is, when as shown in FIG. 4, FAF>0.85, the duty ratio DPG is gradually increased, while when FAF≦0.85, the duty ratio DPG is held constant. As a result, the purge control valve 17 will not rapidly close, so the air-fuel ratio can be prevented from fluctuating.

At step 116, the actual purge rate PGR (=PG100·(DPG/100)) is calculated by multiplying the duty ratio DPG with the full open purge rate PG100. That is, as explained above, the duty ratio DPG is expressed by (tPGR/PG100)·100. In this case, if the target purge rate tPGR becomes larger than the full open purge rate PG100, the duty ratio DPG would become over 100 percent. The duty ratio DPG, however, cannot become over 100 percent. At this time, the duty ratio DPG is made 100 percent, so the actual purge rate PGR becomes smaller than the target purge rate tPGR. Therefore, the actual purge rate PGR is expressed as explained above as PG100·(DPG/100).

Next, at step 117, the duty ratio DPG is made DPG0 and the purge rate PGR is made PGR0. Next, at step 118, the processing for driving the purge control valve 17 is performed. This drive processing is shown in FIG. 7. According, the drive processing shown in FIG. 7 will be explained next.

Figure 7:
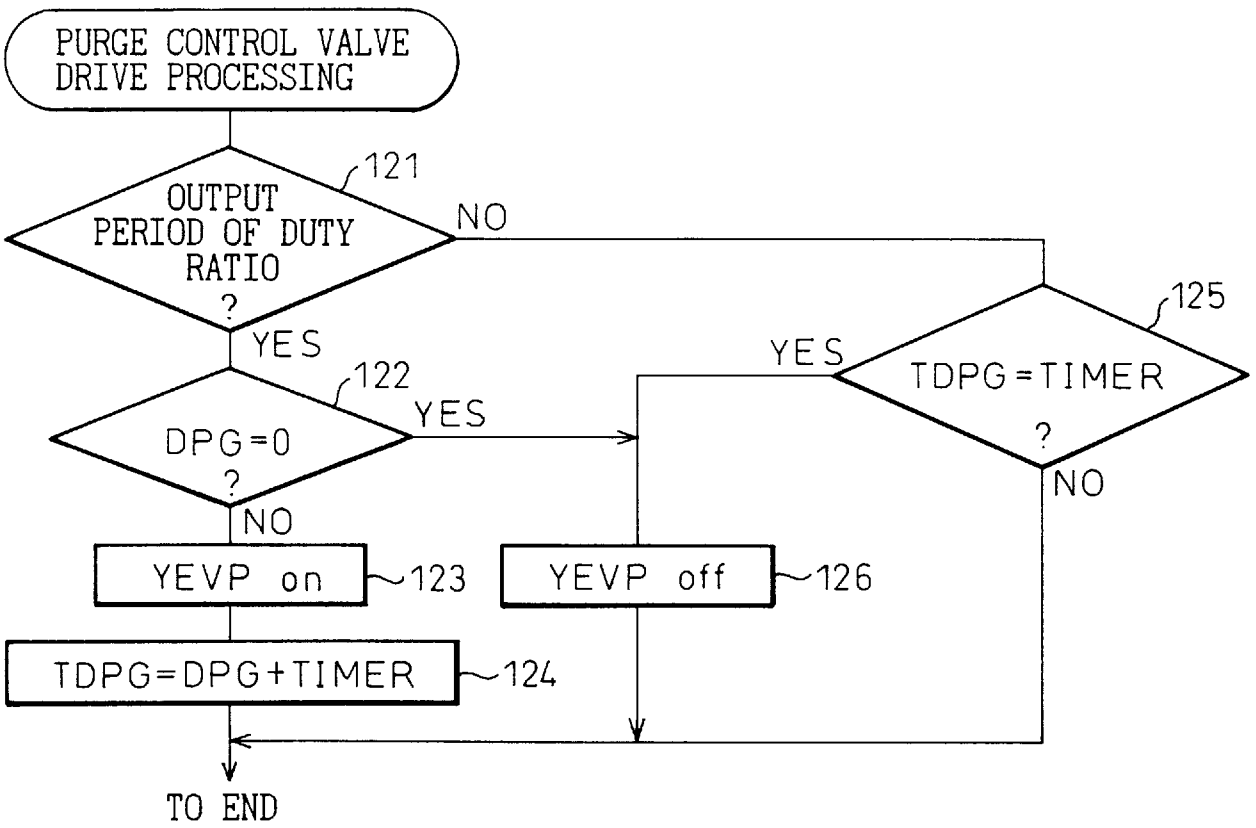
FIG. 7 is a flow chart for the processing for driving the purge control valve.

Referring to FIG. 7, first, at step 121, it is judged if the time is the output period of the duty ratio or not, that is, if it is the rising period of the drive pulse of the purge control valve 17. The output period of the duty ratio is 100 msec. When it is the output period of the duty ratio, the routine proceeds to step 122, where it is judged if the duty ratio DPG is zero or not. When DPG=0, the routine proceeds to step 126, where the drive pulse YEVP of the purge control valve 17 is turned off. As opposed to this, when DPG is not zero, the routine proceeds to step 123, where the drive pulse YEVP of the purge control valve 17 is turned on. Next, at step 124, the duty ratio DPG is added to the current time TIMER to calculate the time TDPG (=DPG+TIMER) of the drive pulse.

On the other hand, when it is judged at step 121 that the time is not the output period of the duty ratio, the routine proceeds to step 125, where it is judged if the current time TIMER is the off time TDPG of the drive pulse. When TDPG=TIMER, the routine proceeds to step 126, where the drive pulse YEVP is turned off.

Figure 8:
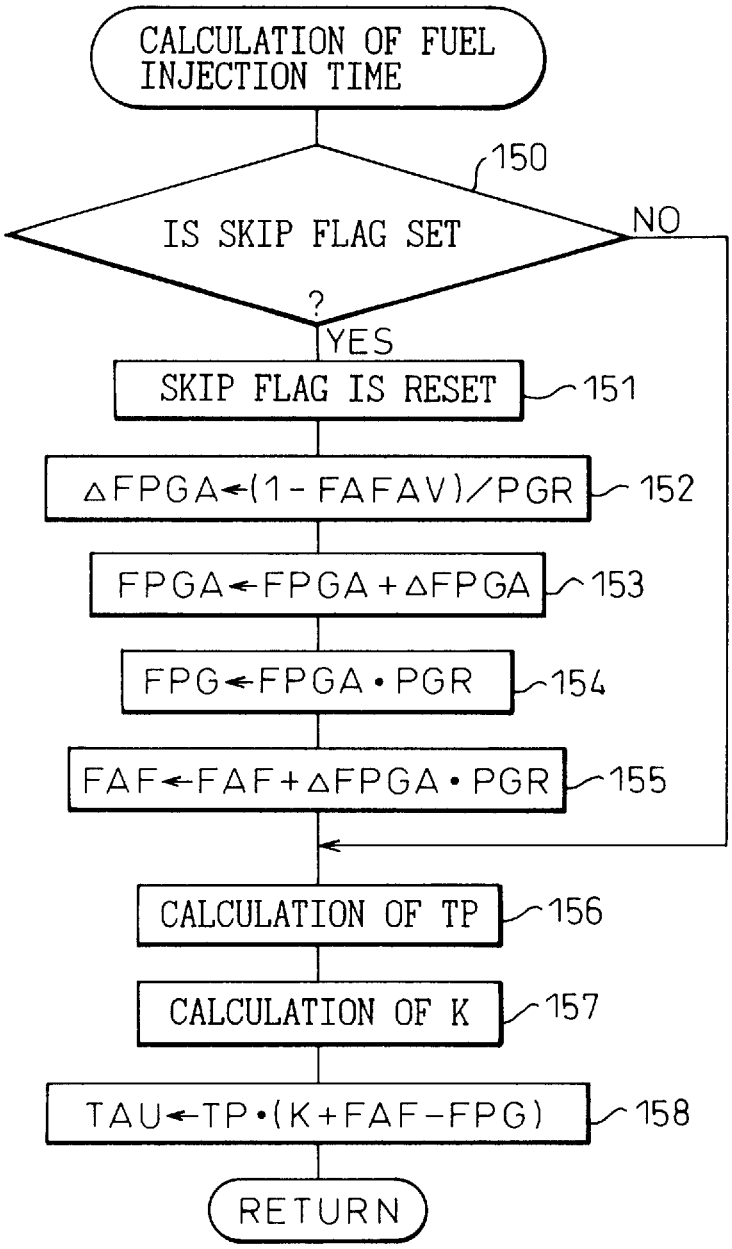
FIG. 8 is a flow chart for calculating a fuel injection time.

FIG. 8 shows the routine for calculation of the fuel injection time TAU. This routine is executed repeatedly.

Referring to FIG. 8, first, at step 150, it is judged if the skip flag which is set at step 45 of FIG. 2 has been set or not. When the skip flag has not been set, the routine jumps to step 156. As opposed to this, when the skip flag has been set, the routine proceeds to step 151, where the skip flag is reset, then the routine proceeds to step 152, where the purge vapor concentration ΔFPGA per unit purge rate is calculated based on the following formula:

$$\Delta FPGA=(1-FAFAV)/PGR$$

That is, the amount of fluctuation (1−FAFAV) of the average air-fuel ratio FAFAV shows the purge vapor concentration therefore by dividing (1−FAFAV) by the purge rate PGR, the purge vapor concentration ΔFPGA per unit purge rate is calculated. Next, at step 153, the purge vapor concentration AFPGA is added to the purge vapor concentration FPGA to update the purge vapor concentration FPGA per unit purge rate. When FAFAV approaches 1.0, ΔFPGA approaches zero, therefore FPGA approaches a constant value. Next, at step 154, the purge rate PGR is multiplied with FPGA to calculate the purge A/F correction coefficient FPG (=FPGA·PGR). Next, at step 155, ΔFPGA·PGR is added to FAF so as to increase the feedback control coefficient FAF by exactly the amount of the increase of the purge A/F correction coefficient FPG. Next, at step 156, the basic fuel injection time TP is calculated, then at step 157, the correction coefficient K is calculated, then at step 158, the injection time TAU (=TP·(k+FAF−FPG)) is calculated.

Figure 9:
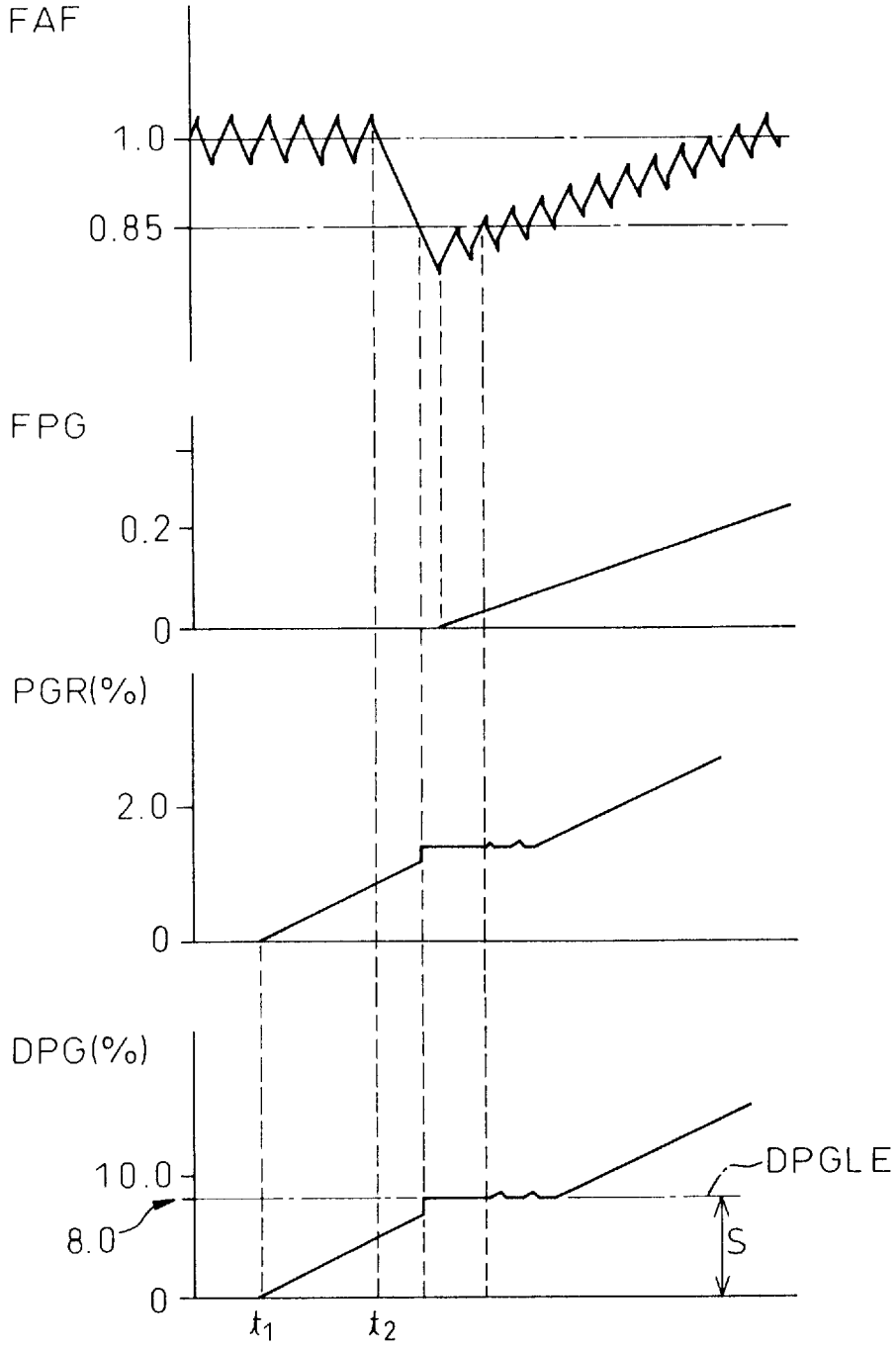
FIG. 9 is a time chart of another embodiment of the purge control.

FIG. 9 shows another embodiment. Note that in FIG. 9, $t_1$, in the same way as in FIG. 4, shows when the purge action is started, while $t_2$ similarly shows when the purge control valve 17 rapidly opens. In this embodiment, when the feedback control coefficient FAF of the air-fuel ratio falls below 0.85, the duty ratio DPG rises up to the minimum duty ratio DPGLE of the stable flow rate.

Next, an explanation will be made of the routine shown in FIG. 10 and FIG. 11 for executing the purge control shown in FIG. 9. Step 200 to step 220 of this routine correspond to step 100 to step 120 of the routine shown in FIG. 5 and FIG. 6. Of the step 200 to step 220, the steps other than step 214 and step 215 are the same as the corresponding steps of FIG. 5 and FIG. 6. Only the step 214 and step 215 differ from the corresponding steps of FIG. 5 and FIG. 6.

Figure 10:
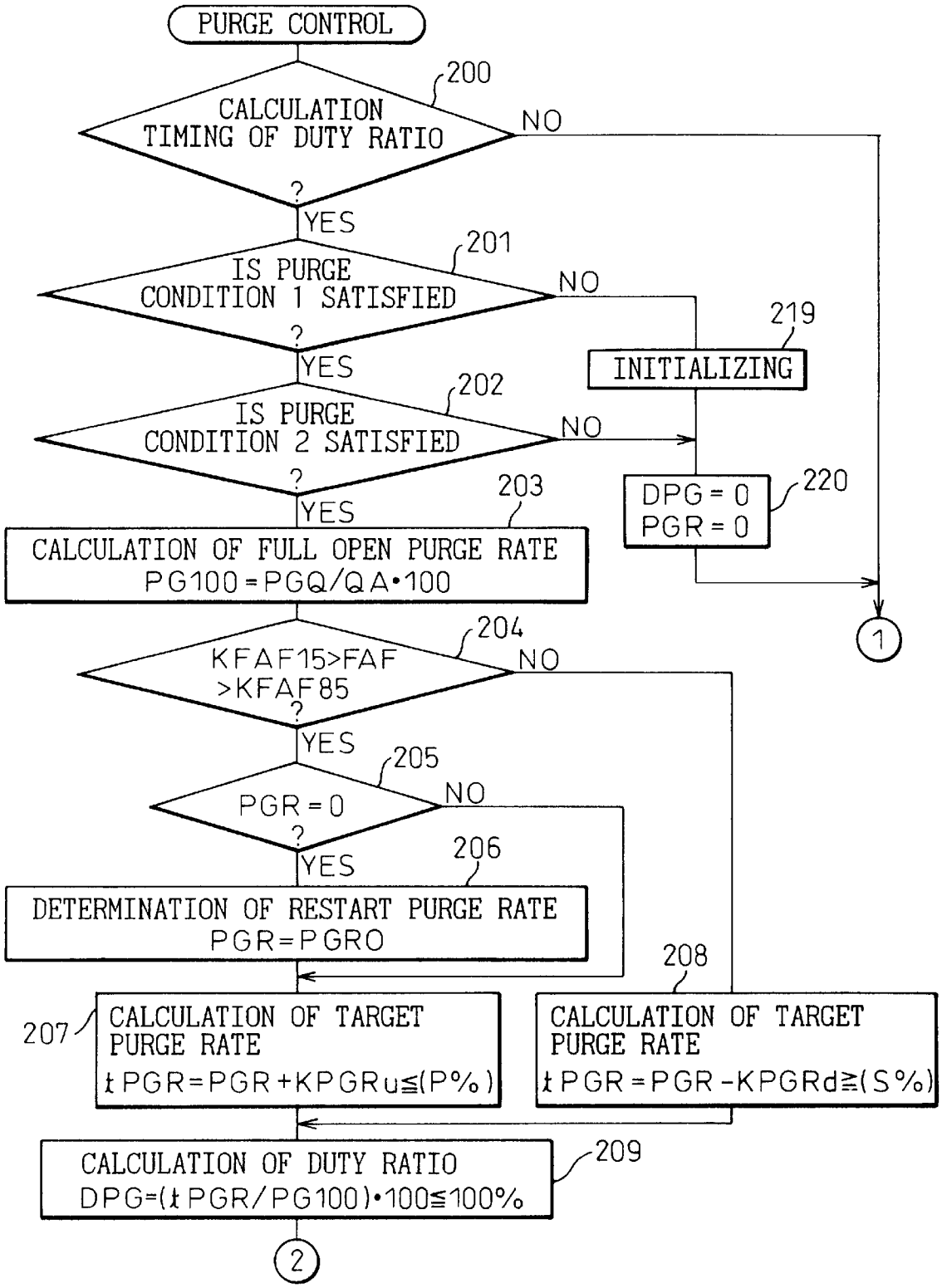
FIGS. 10 and 11 are flow charts for the execution of purge control.
Figure 11:
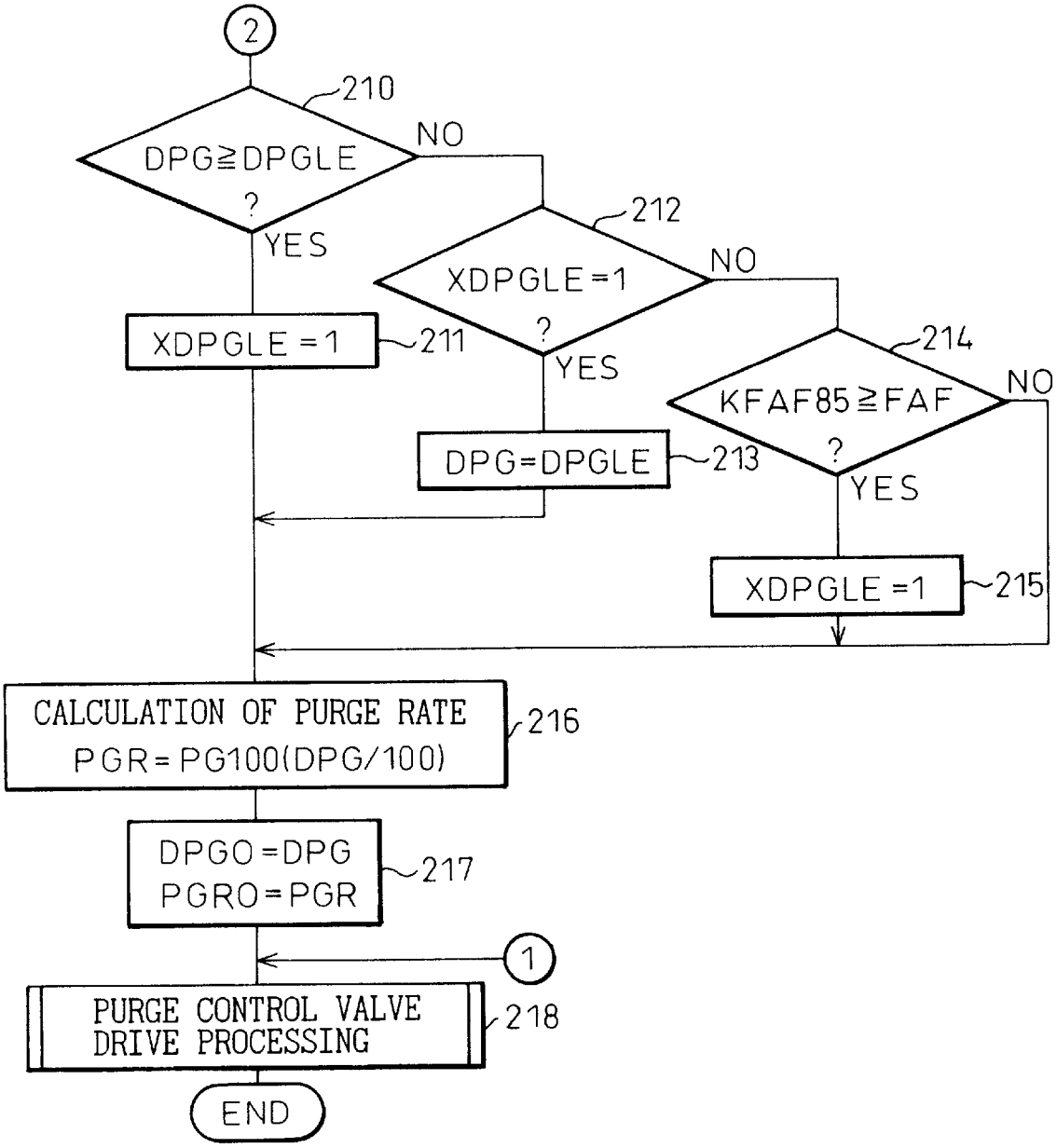

That is, referring to FIG. 10 and FIG. 11, first, at step 200, it is judged if the time is the time for calculating the duty ratio of the drive pulse of the purge control valve 17. As explained above, in this embodiment of the present invention, the duty ratio is calculated every 100 msec. When not the time for calculation of the duty ratio, the routine jumps to step 218, where the processing for driving the purge control valve 17 is performed. As opposed to this, when the time is for calculating the duty ratio, the routine proceeds to step 201, where it is judged if the purge condition 1 is satisfied or not, for example, if the engine warmup has been completed or not. When the purge condition 1 is not satisfied, the routine proceeds to step 219, where the initialization processing is performed, then at step 220, the duty ratio DPG and the purge rate PGR are made zero. As opposed to this, when the purge condition 1 is satisfied, the routine proceeds to step 202, where it is judged if the purge condition 2 is satisfied or not, for example, if feedback control of the air-fuel ratio is being performed or not. When the purge condition 2 is not satisfied, the routine proceeds to step 220, while when the purge condition 2 is satisfied, the routine proceeds to step 203.

At step 203, the ratio between the full open purge amount PGQ and the amount QA of intake air, that is, the full open purge rate PG100 (=(PGQ/QA)·100) is calculated. Next, at step 20, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 205, where it is judged whether the purge rate PGR is zero or not. That is, when the purge action is being performed, PGR>0, so at this time the routine jumps to step 207. As opposed to this, when the purge action has not started, the routine proceeds to step 206, where the purge rate PGR0 is made the restart purge rate PGR, then the routine proceeds to step 207.

At step 207, the target purge rate tPGR (=PGR+KPRGu) is calculated by adding a constant value KPGRu to the purge rate PGR, then the routine proceeds to step 209. On the other hand, when it is judged at step 204 that FAF≧KFAF15 or FAF≦KFAF85, the routine proceeds to step 208, where the constant value KPGRd is subtracted from the purge rate PGR to calculate the target purge rate tPGR (=PGR−KPGRd). Next, the routine proceeds to step 209.

At step 209, the target purge rate tPGR is divided by the full open purge rate PG100 to calculate the duty ratio DPG (=(tPGR/PG100)·100) of the drive pulse of the purge control valve 17.

Next, at step 210, it is judged if the duty ratio DPG is larger than the minimum duty ratio DPGLE of stable flow rate or not. As mentioned above, in the embodiment according to the present invention, the minimum duty ratio DPGLE is made 8 percent. When it is judged at step 210 that DPG≧DPGLE, the routine proceeds to step 211, where the duty ratio lower limit flag XDPGLE showing that the duty ratio DPG after the start of the purge exceeded the minimum duty ratio DPGLE is set (XDPGLE=1). Next, the routine proceeds to step 216.

On the other hand, when DPG<DPGLE, the routine proceeds to step 212, where it is judged if the duty ratio lower limit flag XDPGLE has been set or not. When the duty ratio lower limit flag XDPGLE has been set, the routine proceeds to step 213, where the minimum duty ratio DPGLE is made the duty ratio DPG. That is, if the duty ratio DPG exceeds the minimum duty ratio DPGLE once after the purge action has started, even if the target purge rate tPGR becomes smaller and the duty ratio DPG becomes smaller than the minimum duty ratio DPGLE, the duty ratio DPG will be maintained at the minimum duty ratio DPGLE and therefore the duty ratio DPG will not intrude into the region S of unstable flow.

As opposed to this, when it is judged at step 212 that the duty ratio lower limit flag XDPGLE has not been set, that is, when the duty ratio DPG has not yet exceeded the minimum duty ratio DPGLE after the start of the purge action, the routine proceeds to step 214, where it is judged if the feedback control coefficient FAF is smaller than a constant value KFAF85 (=0.8) or not. When KFAF85<FAF, the routine jumps to step 216, while when KFAF85≧FAF, the routine proceeds to step 215, where the duty ratio lower limit flag XDPGLE is set, then the routine proceeds to step 216. When the duty ratio lower limit flag XDPGLE is set, at the time of calculation of the next duty ratio, the routine proceeds from step 212 to step 213 where the minimum duty ratio DPGLE is made the duty ratio DPG.

That is, when as shown in FIG. 9, FAF>0.85, the duty ratio DPG is gradually increased, while when FAF<0.85, the duty ratio DPG is raised all at once to the minimum duty ratio DPGLE. As a result, the purge control valve 17 will not close rapidly and therefore the air-fuel ratio can be prevented from fluctuating.

At step 216, the actual purge rate PGR (=PG100·(DPG/100)) is calculated by multiplying the duty ratio DPG with the full open purge rate PG100. Next, at step 217, the duty ratio DPG is made DPG0 and the purge rate PGR is made PGR0. Next, at step 218, the processing for driving the purge control valve 17 shown in FIG. 7 is performed.

Figure 12:
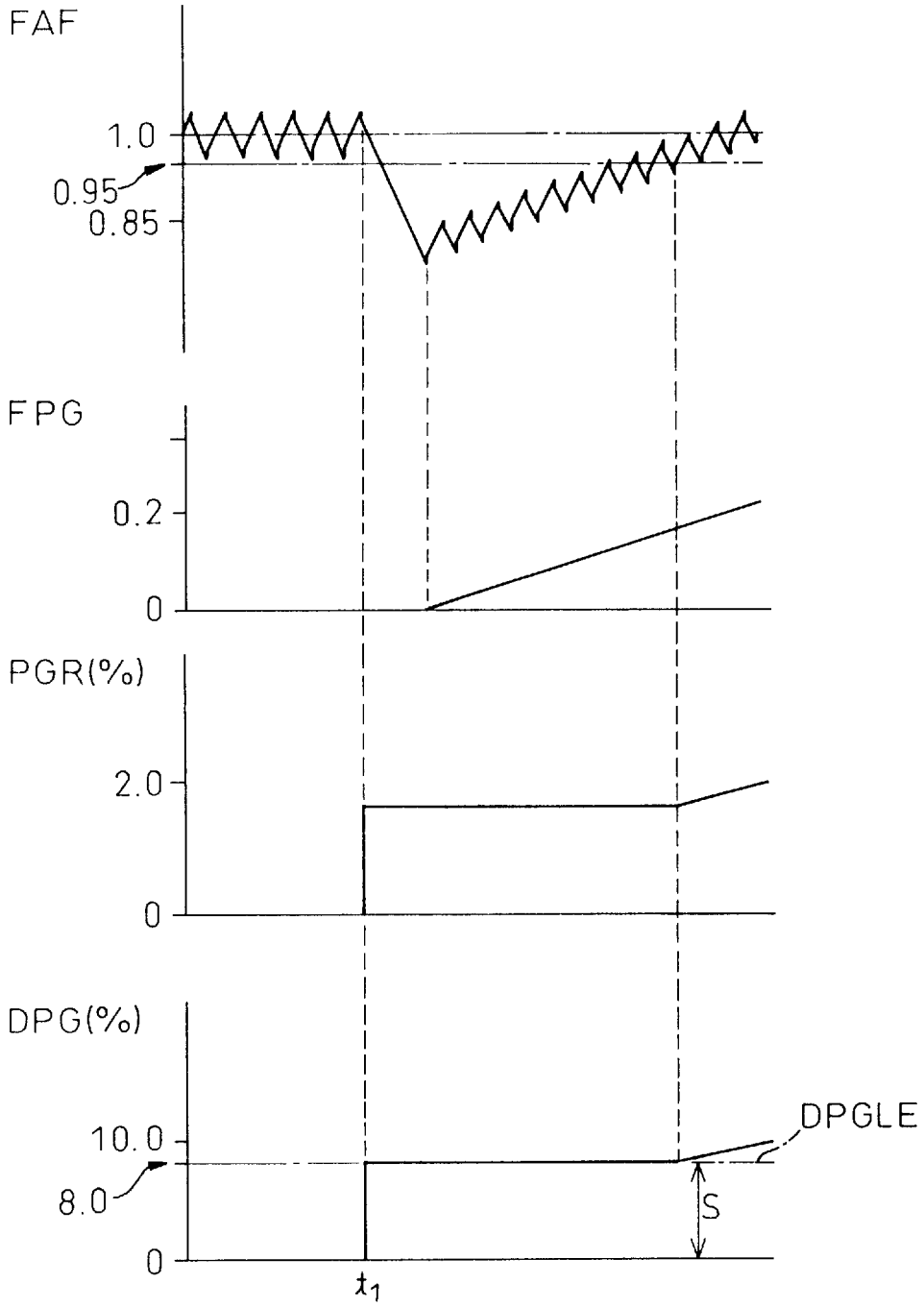
FIG. 12 is a time chart showing another embodiment of the purge control.
Figure 13:
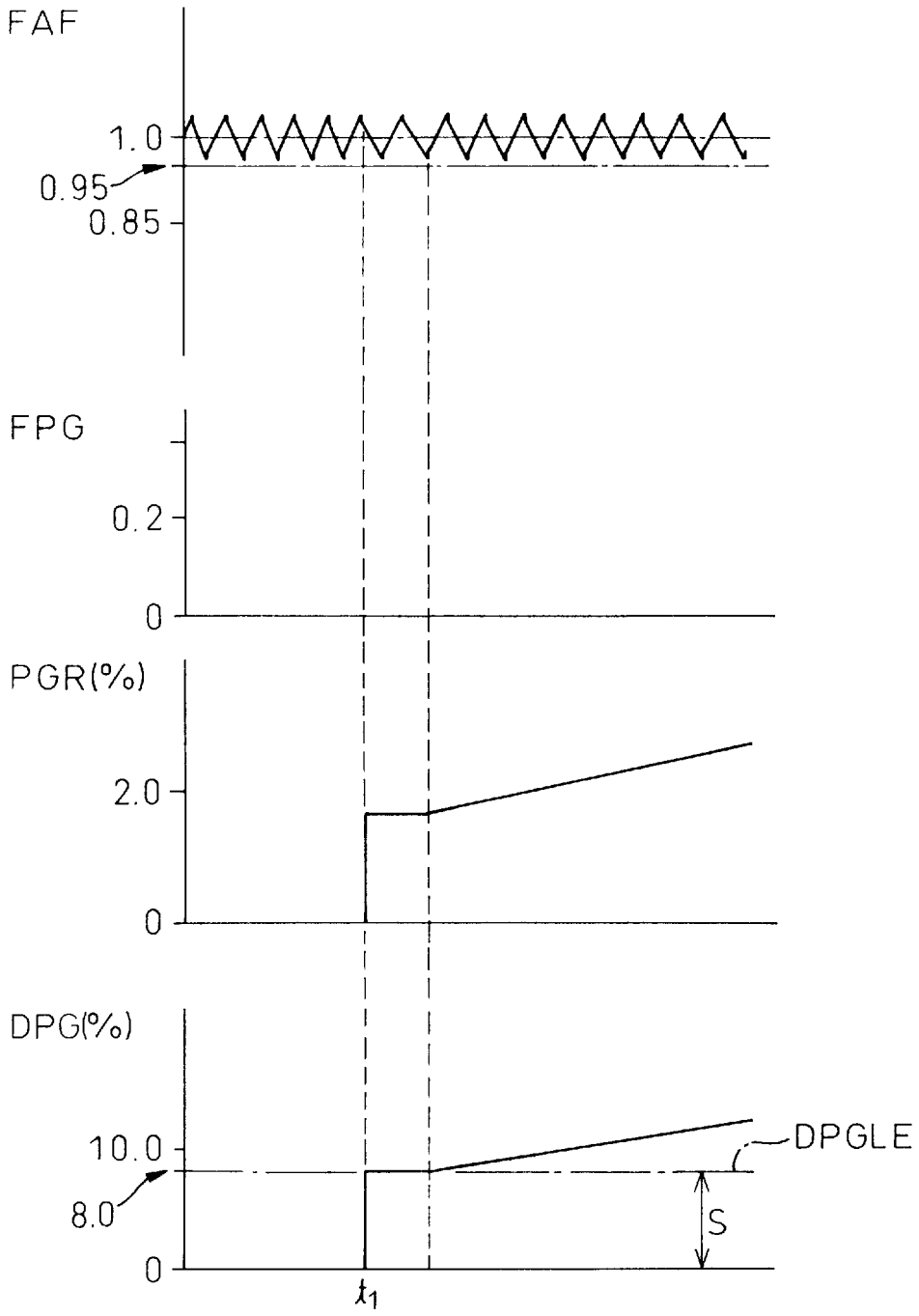
FIG. 13 is a time chart of the purge control.

FIG. 12 and FIG. 13 show still another embodiment. Note that in FIG. 12 and FIG. 13, $t_1$ shows when the purge action is started. As shown in FIG. 12 and FIG. 13, in this embodiment, when the purge action is being started, the duty ratio DPG is raised to the minimum duty ratio DPGLE of the stable flow rate. Then, the duty ratio DPG is maintained at the minimum duty ratio DPGLE. When the skip action (see S in FIG. 3) of the feedback control coefficient FAF is performed three or more times from when the duty ratio DPG is maintained at the minimum duty ratio DPGLE and FAF is in the range of 1.05≧FAFA≧0.95, that is, the duty ratio DPG is maintained at the minimum duty ratio DPGLE, then the feedback control of the air-fuel ratio is stable, the action of increasing the purge rate PGR is started. Note that FIG. 12 shows the case where the air-fuel ratio fluctuates when the purge action is started, while FIG. 13 shows the case where the air-fuel ratio does not fluctuate much at all even when the purge action is started.

Figure 14:
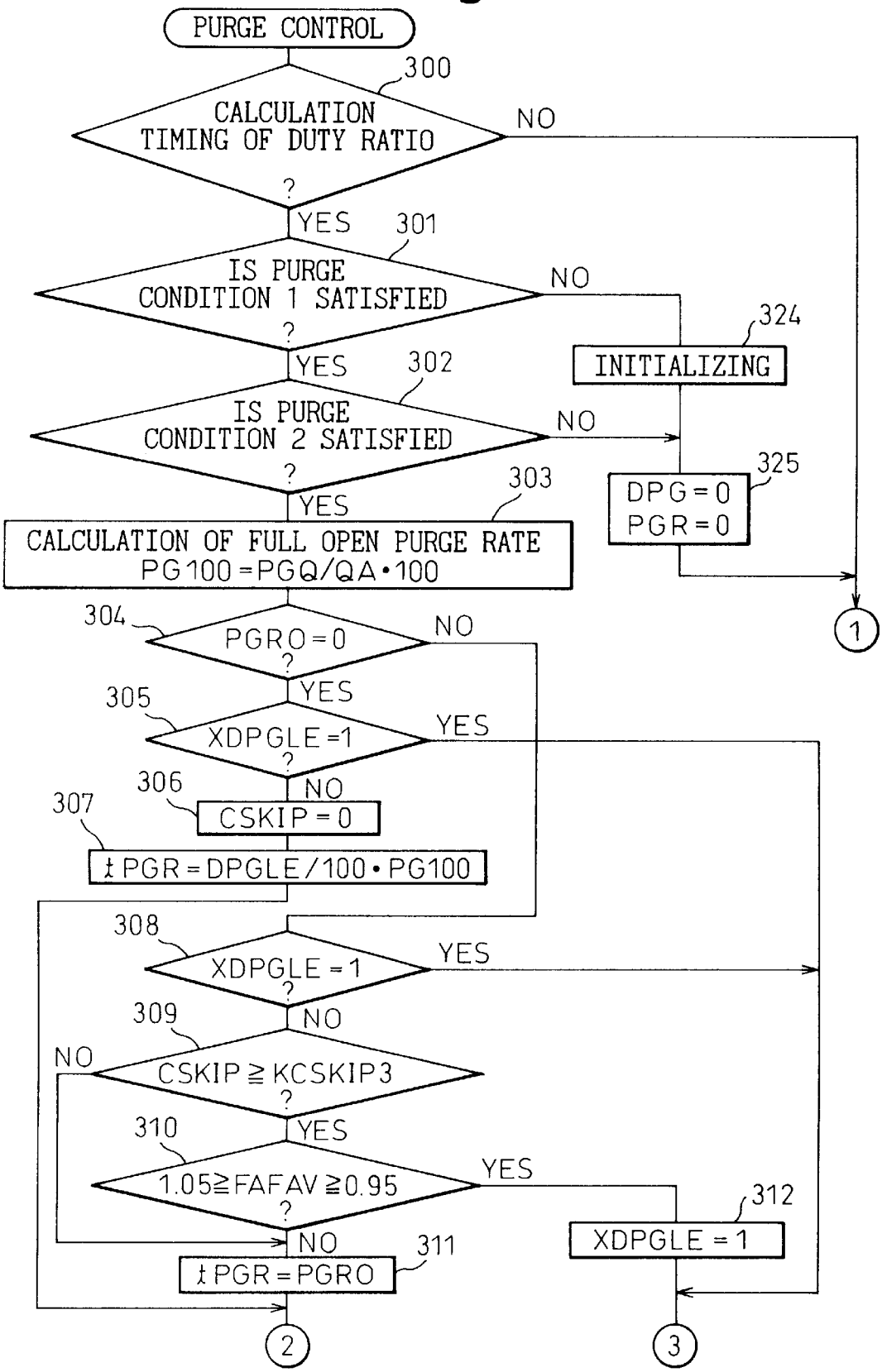
FIGS. 14 and 15 are flow charts for executing the purge control.
Figure 15:
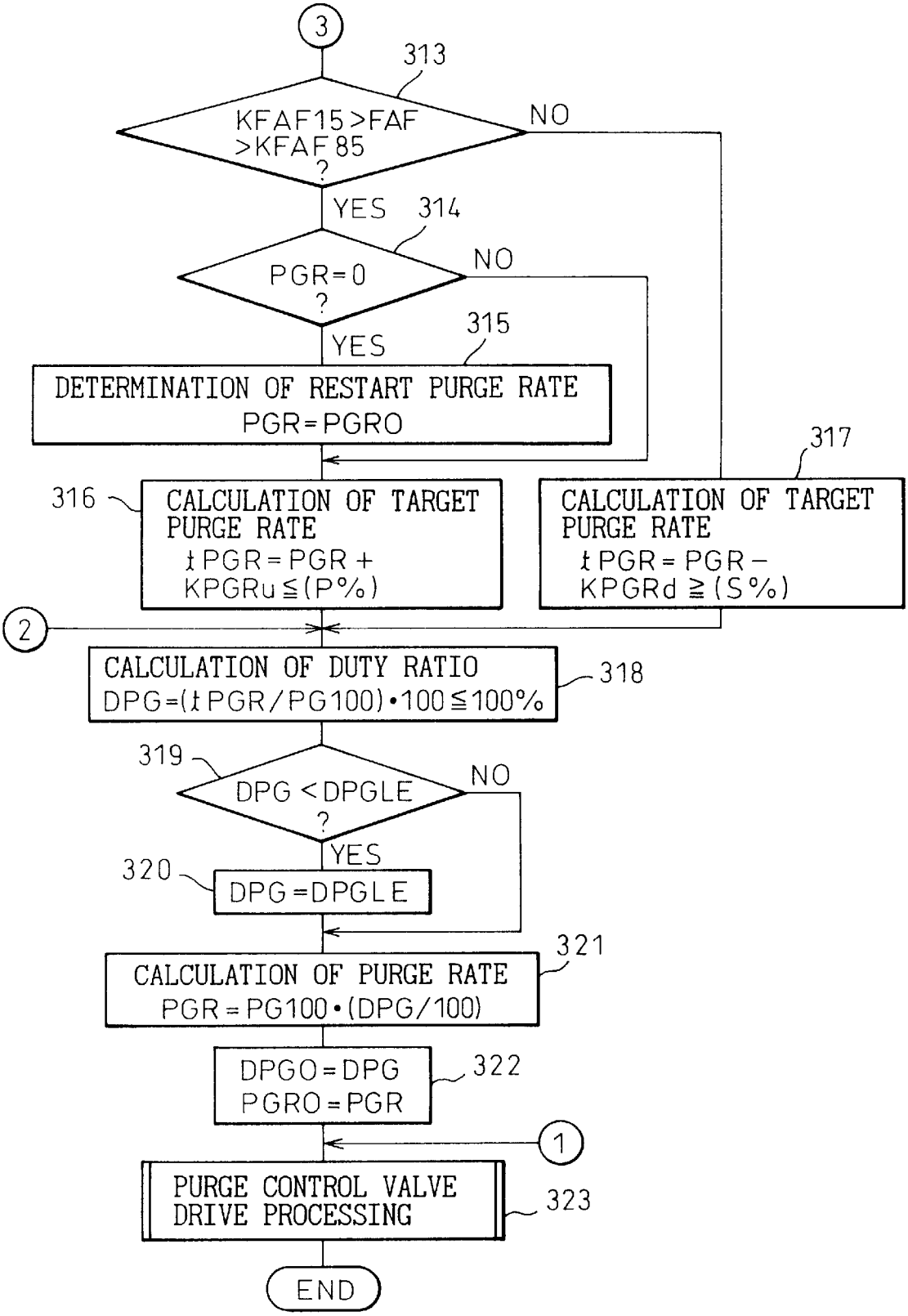

FIG. 14 and FIG. 15 show a routine for executing the purge control shown in FIG. 12 and FIG. 13.

Referring to FIG. 14 and FIG. 15, first, at step 300, it is judged if the time is the time for calculation of the duty ratio of the drive pulse of the purge control valve 17 or not. As explained above, in this embodiment of the present invention, the duty ratio is calculated every 100 msec. If not the time for calculation of the duty ratio, the routine jumps to step 323, where the processing for driving the purge control valve 17 is executed. As opposed to this, if the time for calculation of the duty ratio, the routine proceeds to step 301 where it is judged if the purge condition 1 is satisfied or not, for example, if the engine warmup has been completed or not. When the purge condition 1 is not satisfied, the routine proceeds to step 324, where the initialization processing is performed, then, at step 325, the duty ratio DPG and the purge rate PGR are made zero. As opposed to this, when the purge condition 1 is satisfied, the routine proceeds to step 302, where it is judged if the purge condition 2 is satisfied or not, for example, if the air-fuel ratio is being feedback controlled or not. When the purge condition 2 is not satisfied, the routine proceeds to step 325, while when the purge condition 2 is satisfied, the routine proceeds to step 303.

At step 303, the ratio between the full open purge amount PGQ and the amount QA of intake air, that is, the full open purge rate PG100 (=(PGQ/QA)·100) is calculated. Next, at step 304, it is judged if the previously calculated purge rate PGR0 is zero or not. When PGR0 is zero, that is, when the purge action has not yet started, the routine proceeds to step 305, where it is judged if the duty ratio lower limit flag XDPGLE, which is set when the air-fuel ratio is stable after the start of the purge, has been set or not. The duty ratio lower limit flag XDPGLE is reset when the purge condition 1 and the purge condition 2 are satisfied for the first time after the start of the operation of the engine. Therefore, at this time, the routine proceeds to step 306. At step 306, the skip counter CSKIP which counts the number of skips of the air-fuel ratio feedback control coefficient FAF is cleared. Next, at step 307, the full open purge rate PG100 is multiplied with the minimum duty ratio DPGLE (=8%) of the stable flow rate so as to calculate the target purge rate tPGR (=(DPGLE/100)·PG100).

Next, the routine proceeds to step 318, where the target purge rate tPGR is divided by the full open purge rate PG100 to calculate the duty ratio DPG (=tPGR/PG100)·PG100) of the drive pulse of the purge control valve 17. At this time, the target purge rate tPGR is (DPGLE/100)·PG100, so the duty ratio becomes the minimum duty ratio DPGLE. That is, when the purge action is started, the duty ratio DPG immediately rises to the minimum duty ratio DPGLE as shown in FIG. 12 and FIG. 13.

Next, at step 319, it is judged if the duty ratio DPG is smaller than the minimum duty ratio DPGLE or not. When DPG≧DPGLE, the routine jumps to step 321, while when DPG<DPGLE, at step 320, the minimum duty ratio DPGLE is made the duty ratio DPG, then the routine proceeds to step 321. At step 321, the actual purge rate PGR (=PG100·(DPG/100)) is calculated by multiplying the duty ratio DPG with the full open purge rate PG100. Next, at step 322, the duty ratio DPG is made DPG0 and the purge rate PGR is made PGR0. Next, at step 323, the processing for driving the purge control valve 17 shown in FIG. 7 is performed.

If the purge action is started, when it is judged at step 304 that PGRO is not zero, the routine proceeds to step 308, where it is judged if the duty ratio lower limit flag XDPGLE is set or not. When the purge action is started for the first time after the start of the engine, the duty ratio lower limit flag XDPGLE is reset, so the routine proceeds to step 309, where it is judged if the skip count value CSKIP has become larger by a constant value CSKIP3, for example, 3 or not. When CSKIP<KCSKIP3, the routine jumps to step 311, where the previously calculated duty ratio PGR0 is made the target duty ratio tPGR and the routine proceeds to step 318.

On the other hand, when it is judged at step 309 that CSKIP≧KCSKIP3, the routine proceeds to step 310, where it is judged if the average value FAFAV of the feedback control coefficient is 1.05≧FAFAV≧0.95 or not, that is, if the feedback control is stable or not. When FAFAV>1.05 or FAFAV<0.95, the routine proceeds to step 311. Therefore, as shown in FIG. 12 and FIG. 13, the duty ratio DPG is maintained at the minimum duty ratio DPGLE until the skip action of the feedback control coefficient FAF is performed three times from the start of the purge action. Even after the skip action of the FAF is performed three times, so long as FAFAV>1.05 or FAFAV<0.85, the duty ratio DPG will be maintained at the minimum duty ratio DPGLE.

Next, when it is judged at step 310 that 1.05≧FAFAV≧0.95, the routine proceeds to step 312, where the duty ratio lower limit flag XDPGLE is set, then the routine proceeds to step 313. At step 313, it is judged if the feedback control coefficient FAF is between the upper limit value KFAF15 (=1.15) and the lower limit value KFAF85 (=0.85) or not. When KFAF15>FAF>KFAF85, that is, when the air-fuel ratio is being feedback controlled to the stoichiometric air-fuel ratio, the routine proceeds to step 314, where it is judged if the purge rate PGR is zero or not. When the purge action is already being performed, PGR>0, so at this time the routine jumps to step 316. As opposed to this, when the purge action has not yet started, the routine proceeds to step 315, where the purge rate PGR0 is made the restart purge rate PGR.

Next, at step 316, a constant value KPGRu is added t the purge rate PGR to calculate the target purge rate tPGR (=PGR+KPGRu). Next, the routine proceeds to step 318. On the other hand, when it is judged at step 313 that FAF≧KFAF15 or that FAF≦KFAF85, the routine proceeds to step 317, where the constant value KPGRd is subtracted from the purge rate PGR to calculate the target purge rate tPGR (=PGR−KPGRd). Therefore, at step 310, if it is judged that 1.05≧FAFAV≧0.95, the purge rate PGR is gradually increased.

On the other hand, when it is judged at step 305 that the duty ratio lower limit flag XDPGLE is set, that is, when the purge action has been suspended once during the engine operation and then the purge action started, the routine jumps to step 313. At this time, the purge rate PGRO immediately before the purge action is made the purge rate PGR at step 315.

As mentioned above, according to the present invention, it is possible to prevent the air-fuel ratio from fluctuating when the purge action is started.

While the invention has been described by reference to specific embodiments chosen for purposes of illustration, it should be apparent that numerous modifications could be made thereto by those skilled in the art without departing from the basic concept and scope of the invention.

I claim:

1. An evaporated fuel treatment device for an engine provided with an intake passage, comprising:

a purge control valve for controlling an amount of purge of fuel vapor to be purged to the intake passage;

air-fuel ratio detecting means for detecting the air-fuel ratio;

valve opening controlling means for increasing or reducing the amount of opening of the purge control valve in accordance with fluctuations in the air-fuel ratio when the purge action of the fuel vapor has been started so as to make the purge control valve gradually open from the fully closed state to the target opening degree;

judging means for judging if the amount of opening of the purge control valve is in a predetermined region of unstable flow; and prohibiting means for prohibiting the amount of opening of the purge control valve from being reduced when the amount of opening of the purge control valve is in the region of unstable flow.

2. An evaporated fuel treatment device as set forth in claim 1, wherein when the purge control valve is in the region of unstable flow and the air-fuel ratio is in a state of fluctuation where the amount of opening of the purge control valve should be reduced, the amount of opening of the purge control valve is held at the amount of opening at that time.

3. An evaporated fuel treatment device as set forth in claim 1, wherein when the purge control valve is in the region of unstable flow and the air-fuel ratio is in a state of fluctuation where the amount of opening of the purge control valve should be reduced, the amount of opening of the purge control valve is opened until the minimum amount of opening of stable flow.

4. An evaporated fuel treatment device as set forth in claim 1, wherein the valve opening controlling means gradually increases the amount of opening of the purge control valve when the air-fuel ratio is in a predetermined air-fuel ratio region including the stoichiometric air-fuel ratio and gradually reduces the amount of opening of the purge control valve when the air-fuel ratio is outside of the air-fuel ratio region.

5. An evaporated fuel treatment device as set forth in claim 4, wherein the amount of fuel injection is corrected by a feedback control coefficient based on the air-fuel ratio detected by said air-fuel ratio detecting means so that the air-fuel ratio becomes the target air-fuel ratio and said valve opening controlling means gradually increases the amount of opening of the purge control valve when the feedback control coefficient is in a predetermined range and gradually reduces the amount of opening of the purge control valve when the air-fuel ratio is outside of the predetermined range.

6. An evaporated fuel treatment device as set forth in claim 1, wherein the region of unstable flow is from the fully closed state of the purge control valve to a slightly open state thereof.

7. An evaporated fuel treatment device as set forth in claim 1, wherein calculating means is provided for calculating the target purge rate and the valve opening controlling means gradually opens the purge control valve from the fully closed state so that the purge rate increase along with the target purge rate.

8. An evaporated fuel treatment device as set forth in claim 7, wherein means is provided for finding a full open purge rate for when the purge control valve is fully open and the amount of opening of the purge control valve is determined by dividing the target purge rate by the full open purge rate.

9. An evaporated fuel treatment device for an engine provided with an intake passage, comprising:

a purge control valve for controlling an amount of purge of fuel vapor to be purged to the intake passage; and valve opening controlling means for instantaneously opening the purge control valve from the fully closed state to the minimum amount of opening of stable flow and holding it temporarily at the minimum amount of opening when the purge action of the fuel vapor has started and then gradually opening the purge control valve toward the target degree of opening.

10. An evaporated fuel treatment device as set forth in claim 9, wherein said valve opening controlling means holds the purge control valve temporarily at the minimum amount of opening, then gradually increasing the amount of opening of the purge control valve when the air-fuel ratio is in a predetermined air-fuel ratio region including the stoichiometric air-fuel ratio and gradually reducing the amount of opening of the purge control valve when the air-fuel ratio is outside of the air-fuel ratio region.

11. An evaporated fuel treatment device as set forth in claim 10, wherein the amount of fuel injection is corrected by a feedback control coefficient based on the air-fuel ratio detected by air-fuel ratio detecting means so that the air-fuel ratio becomes the target air-fuel ratio and said valve opening controlling means gradually increases the amount of opening of the purge control valve when the feedback control coefficient is in a predetermined range and gradually reduces the amount of opening of the purge control valve when the air-fuel ratio is outside of the predetermined range.

12. An evaporated fuel treatment device as set forth in claim 9, wherein calculating means is provided for calculating a target purge rate and the valve opening control means gradually opens the purge control valve so that the purge rate increases along with the target purge rate.

13. An evaporated fuel treatment device as set forth in claim 12, wherein means is provided for finding a full open purge rate for when the purge control valve is fully open and the amount of opening of the purge control valve is determined by dividing the target purge rate by the full open purge rate.

* * * * *